US011499806B2

(12) United States Patent
Lumley

(10) Patent No.: US 11,499,806 B2
(45) Date of Patent: Nov. 15, 2022

(54) DETONATION WAVEFRONT CONTROLLER

(71) Applicant: LINEAR SHAPED LIMITED, Hartlepool (GB)

(72) Inventor: Andrew Lumley, Alston (GB)

(73) Assignee: LINEAR SHAPED LIMITED, Hartlepool (GB)

( * ) Notice: Subject to any disclaimer, the term of this patent is extended or adjusted under 35 U.S.C. 154(b) by 9 days.

(21) Appl. No.: 17/167,656

(22) Filed: Feb. 4, 2021

(65) Prior Publication Data

US 2021/0180922 A1 Jun. 17, 2021

Related U.S. Application Data

(63) Continuation of application No. PCT/GB2019/052204, filed on Aug. 6, 2019.

(30) Foreign Application Priority Data

Aug. 6, 2018 (GB) ..... 1812780

(51) Int. Cl.
*F42B 1/04* (2006.01)
*F42B 1/02* (2006.01)
*F42B 3/26* (2006.01)

(52) U.S. Cl.
CPC ..... *F42B 1/04* (2013.01); *F42B 1/02* (2013.01); *F42B 3/26* (2013.01)

(58) Field of Classification Search
CPC ..... F41B 1/04; F41B 1/02; F42B 3/26
(Continued)

(56) References Cited

U.S. PATENT DOCUMENTS 5,594,196 A 1/1997 Rontey et al.
8,006,621 B1 * 8/2011 Cherry ..... F42D 3/00 102/476

(Continued)

FOREIGN PATENT DOCUMENTS

CN 2573669 Y 9/2003
CN 204100928 U 1/2015

(Continued)

OTHER PUBLICATIONS

International Search Report and Written Opinion dated Nov. 29, 2019 for PCT Application No. PCT/GB2019/052204.

(Continued)

*Primary Examiner* — Samir Abdosh
(74) *Attorney, Agent, or Firm* — EIP US LLP

(57) ABSTRACT

A detonation wavefront controller for a linear shaped charge, comprising a first part and a second part. The first part comprises: a detonator holder, and a first aperture having a first width and a shape which is substantially a cyclic polygon, substantially an ellipse or substantially circular. The second part comprises: a second aperture having a second width larger than the first width. With the first part at least partly received within the second part, the first part is moveable relative to the second part to configure the detonation wavefront controller at least between: a first configuration with a first distance between the first aperture and the second aperture, and a second configuration with a second distance between the first aperture and the second aperture, the second distance larger than the first distance.

20 Claims, 11 Drawing Sheets

(58) Field of Classification Search
USPC ..... 102/307
See application file for complete search history.

(56) References Cited

U.S. PATENT DOCUMENTS

| | | | | |
|---|---|---|---|---|
| 2012/0210899 | A1* | 8/2012 | Greene | F42B 3/093 102/307 |
| 2015/0275642 | A1 | 10/2015 | Braithwaite et al. | |
| 2017/0122710 | A1 | 5/2017 | Scheid et al. | |
| 2017/0227340 | A1 | 8/2017 | Van Niekerk et al. | |
| 2018/0038670 | A1 | 2/2018 | Scheid et al. | |

FOREIGN PATENT DOCUMENTS

| | | | | |
|---|---|---|---|---|
| CN | 105277416 | A | 1/2016 | |
| EP | 0500512 | A2 | 8/1992 | |
| GB | 2242965 | A * | 10/1991 | F42B 3/26 |
| GB | 2242965 | A | 10/1991 | |
| WO | WO-2021052974 | A2 * | 3/2021 | F42B 1/02 |

OTHER PUBLICATIONS

Chinese office action dated Jul. 27, 2022, for Chinese Application No. 2019800520933.

* cited by examiner

DETONATION WAVEFRONT CONTROLLER

CROSS-REFERENCE TO RELATED APPLICATIONS

This application is a continuation of International Application No. PCT/GB2019/052204, filed Aug. 6, 2019 which claims priority to UK Application No. GB 1812780.3, filed Aug. 6, 2018, under 35 U.S.C. § 119(a). Each of the above-referenced patent applications is incorporated by reference in its entirety.

BACKGROUND

Field of the Invention

A linear shaped charge can be detonated for example by using a detonator inserted into the explosive layer of the charge. However, a standard detonator is not always suitable for a particular cutting task to be performed by the linear shaped charge.

It is desirable to improve detonation of linear shaped charges.

DETAILED DESCRIPTION

Figure 1:
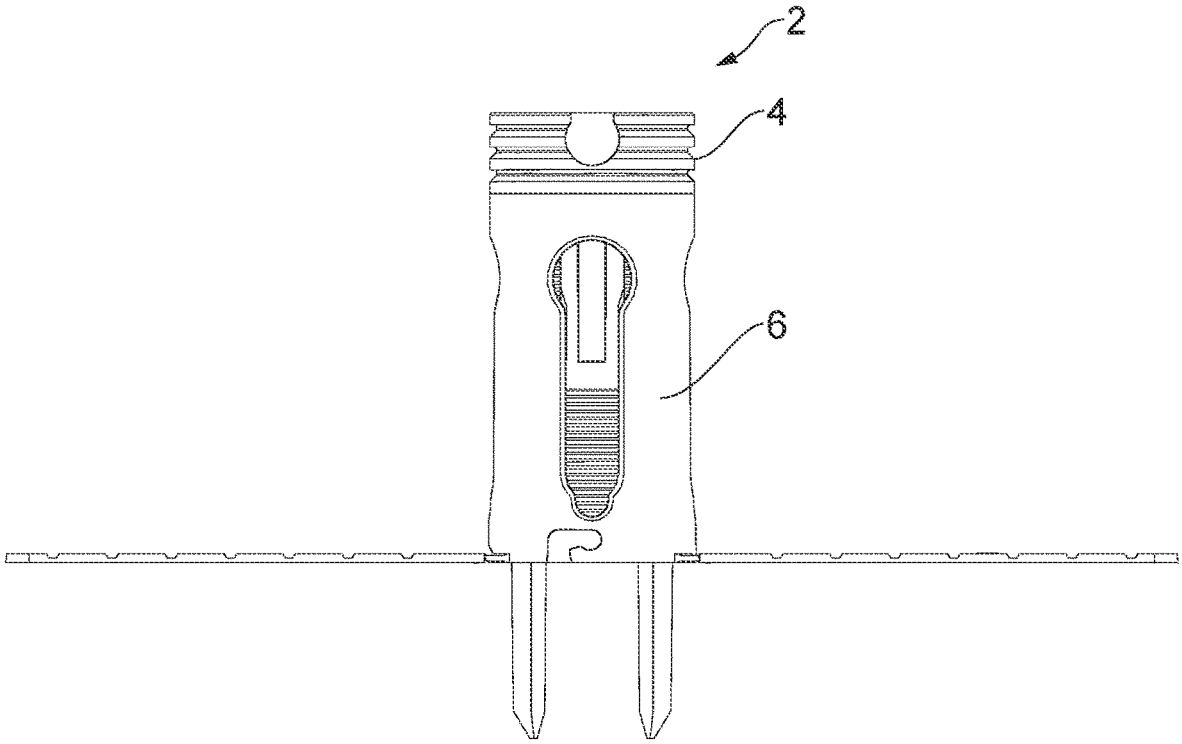
FIG. 1 shows schematically a detonation wavefront controller (DWC) in a first configuration, according to examples.

A common detonator, for example a so-called L2A2 detonator (available from Chemring Energetics UK, Troon House, Ardeer Site, Stevenson, Ayrshire KA20 3LN, Scotland, UK) or a so-called TE-Instantaneous Electric Detonator (available from Orica, 1 Nicholson Street, East Melbourne, Victoria 3002, Australia), can output, upon detonation, a detonation wavefront with a pre-determined form. This detonation wavefront is determined by the construction of the detonator itself. However, owing to the longitudinal shape of a linear shaped charge which fires a longitudinal cutting jet at a target, rather than so-called point shaped charges which fire at a non-longitudinal point on a target, it has been realised that the firing behaviour of a linear shaped charge may be tuned for a given task by controlling a form of a detonation wavefront.

One option to give more control over the form of the wavefront is to provide different detonators which output differently shaped detonation wavefronts. However, this is not practical in situations where a linear shaped charge is commonly used. For example, in remote locations, it may be simpler to keep a stock of the same detonator with the same detonation performance, to ensure that errors in choosing the correct detonator do not occur, which might otherwise cause a compromised or unpredictable firing of the linear shaped charge.

The insight of examples herein lies in controlling a detonation wavefront which has been output by a detonator, so that a desired detonation wavefront may be selected, or more closely obtained, for a desired firing behaviour of a linear shaped charge. In this way, using the detonation wavefront controller of examples described herein, a user may control the form of a detonation wavefront input to the explosive of a linear shaped charge, to optimise the performance of the linear shaped charge for a given cutting task. For example, as explained below, a proportion of explosive energy directed towards the target (for example directed in a plane coincident with a longitudinal axis of the linear shaped charge and which includes an apex of the liner (described below) and which intersects a surface of the linear shaped charge for contact with the target), compared with a proportion directed along the length of the linear shaped charge, may be controlled.

A detonator is a device used to trigger an explosive material, such as of a linear shaped charge, to explode or detonate. Often, detonation is triggered using an electrical signal which detonates, for example initiates combustion of, a primary explosive material, which in turn outputs sufficient energy from the detonator to cause detonation of the explosive material of the linear shaped charge. The explosive material of the linear shaped charge may therefore be referred to as a second explosive.

Energy output from detonation of a detonator may be considered to have the form of a detonation wave or a shock wave. A wavefront of such a wave has a shape or form which depends on factors such as: the rate of energy release by the explosive material upon detonation, and how uniformly in space the energy is released by the explosive material upon detonation. Another factor is whether the wavefront, as it propagates, encounters any structures which may modify the shape or form of the wavefront. One of more such structures may for example absorb, reflect, re-direct or diffract at least part of the wavefront. In this way, a curvature of a wavefront, a spacing between consecutive wavefronts, and/or a rate of propagation of a wavefront may be determined.

Examples will now described of a detonation wavefront controller. Such a controller is configurable between different configurations which respectively cause a detonation wavefront with a different waveform to be output, despite using the same type of detonator. This gives a user flexibility to select, or "dial-in", a desired detonation wavefront for detonating a linear shaped charge. In examples, the detonation wavefront controller may be provided separately to a linear shaped charge, for insertion into an explosive material of the linear shaped charge. In other examples, it is envisaged that the linear shaped charge may be manufactured with the detonation wavefront controller already provided, for example as an integral part of the linear shaped charge. In alternative examples, the detonation wavefront controller may be provided with a detonator; for example the detonator may be integrally formed as part of the detonation wavefront controller.

Examples are described herein with a first aperture of a first part.

Figure 2:
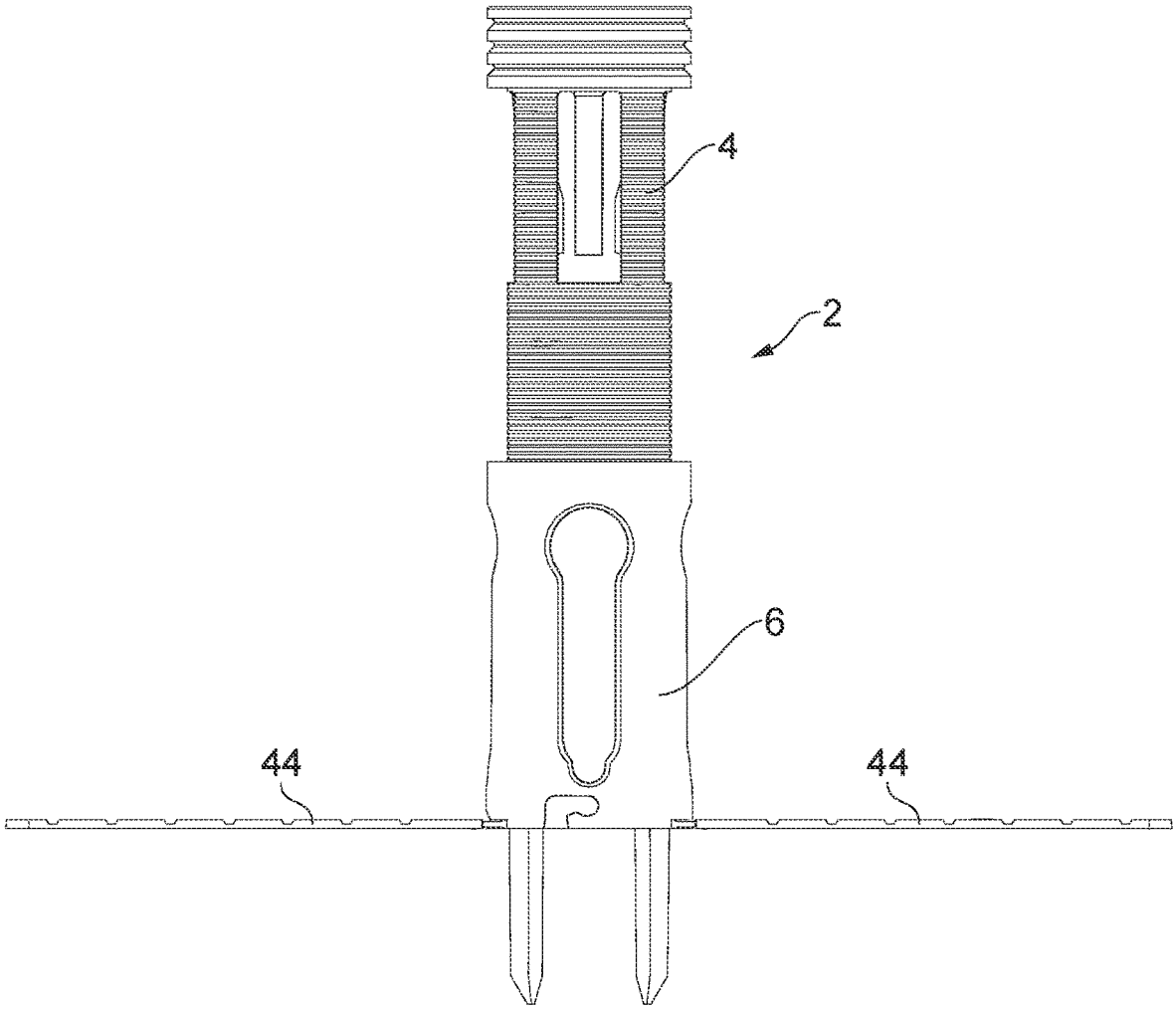
FIG. 2 shows the DWC of FIG. 1 in a second configuration.

FIGS. 1 and 2 each schematically show a side view of a detonation wavefront controller 2 (elsewhere referred to herein as a DWC) according to examples. FIG. 1 shows the DWC in a first configuration and FIG. 2 shows the DWC in a second configuration. In the first configuration, a first part 4 of the DWC is at least partly received within a second part 6. The first configuration may be considered a collapsed or un-extended state and the second configuration may be considered an un-collapsed or extended state. In some examples, where for example the first and second parts are cylindrical or tubular, the DWC may be considered to have a telescopic function, with the first and second parts being concentric to one another, and their movement relative to each other being a sliding towards or away from each other, to contract or extend the DWC.

The first part is now described in further detail using FIGS. 3*a* to 3*e*, which respectively show the first part schematically in a side view, a perspective view, a cutaway view, a top view and a bottom view. The second part is then described in further detail using FIGS. 4*a* to 4*e*, which respectively show the second part schematically in a side view, a perspective view, a cutaway view, a bottom view and a top view. Note that for clarity FIGS. 3*a* to 4*e* show the first part and the second part separate from each other, however, as shown in FIGS. 1 and 2, the DWC has the first part engaged with the second part, as will be explained later.

Figure 3A:
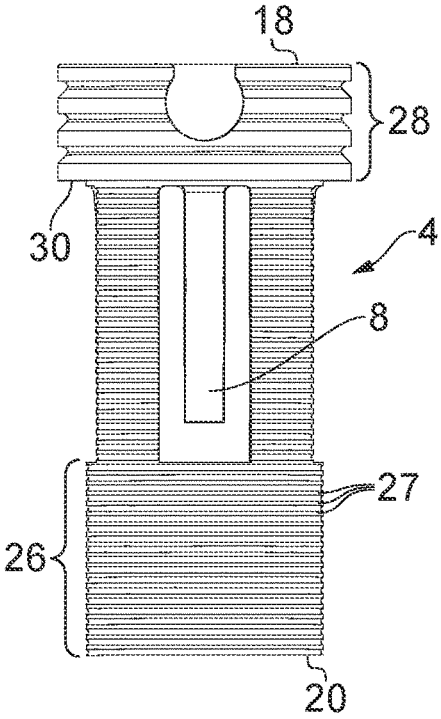
FIGS. 3*a* to 3*e* show various views of a first part of the DWC of FIG. 1.
Figure 3B:
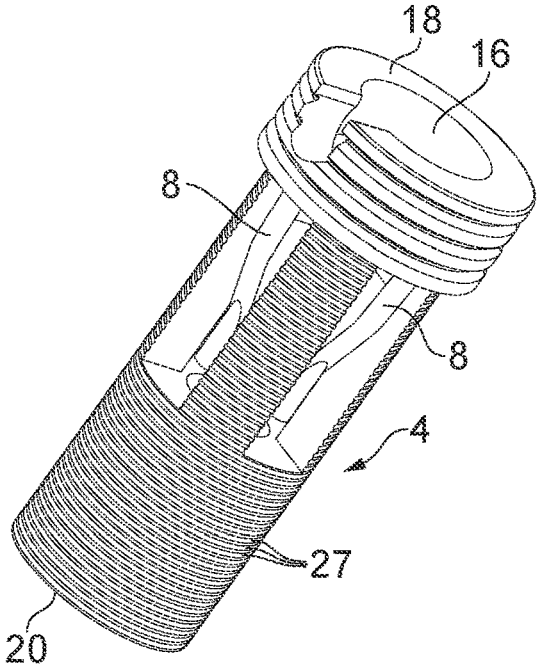
Figure 3C:
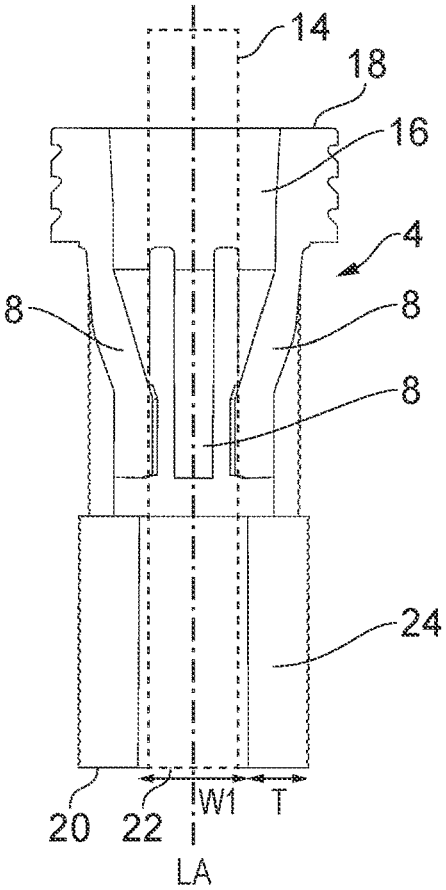
Figure 3D:
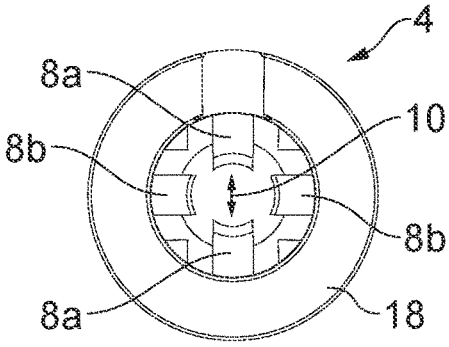
Figure 3E:
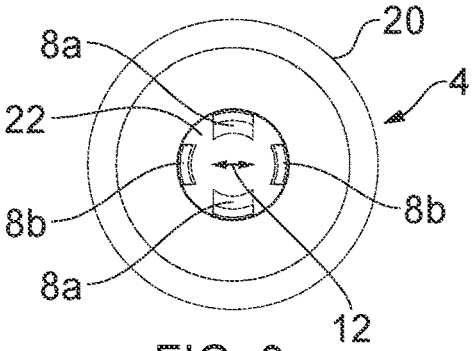
Figure 4A:
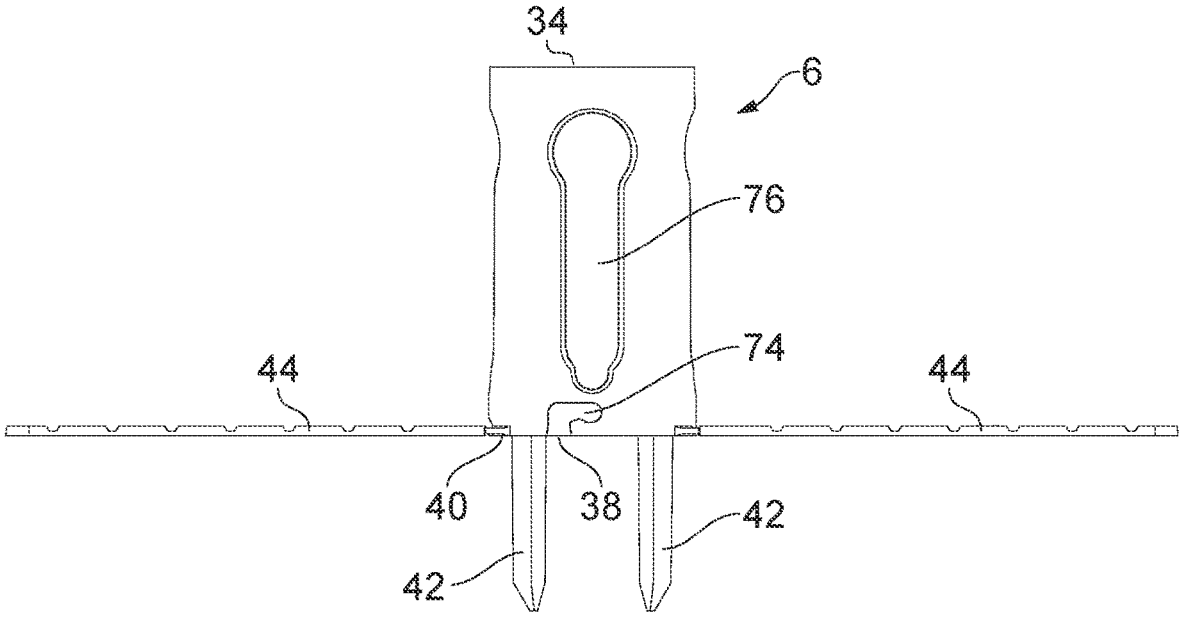
FIGS. 4*a* to 4*e* show various views of a second part of the DWC of FIG. 1.
Figure 4B:
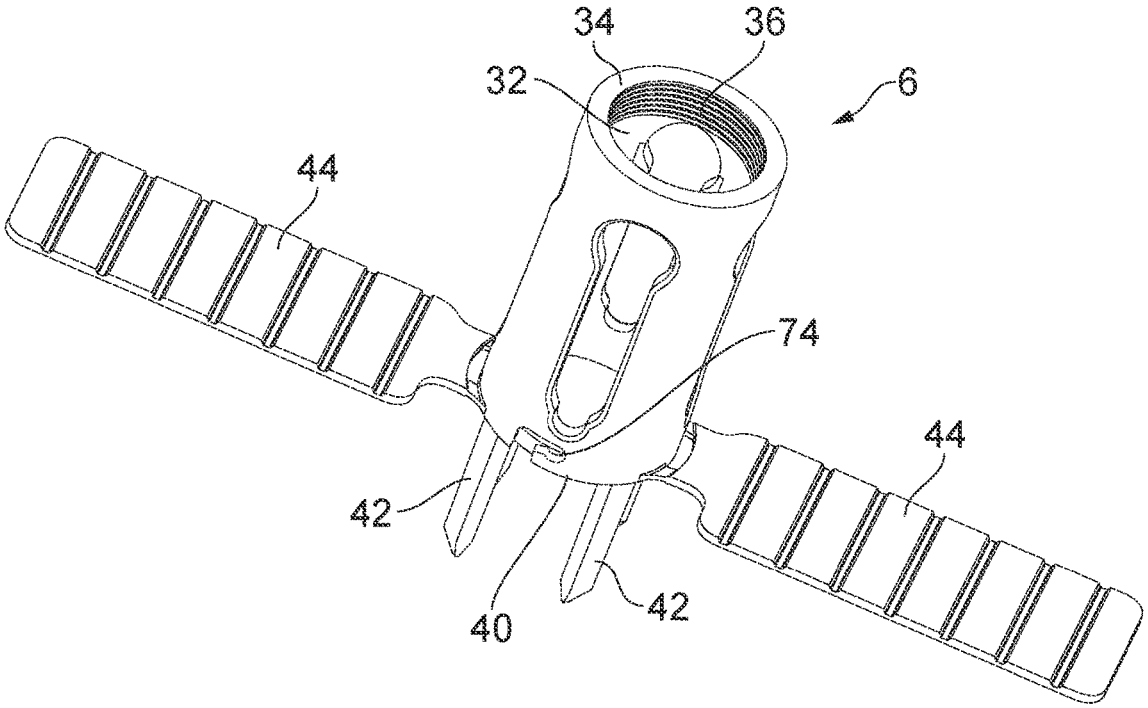
Figure 4C:
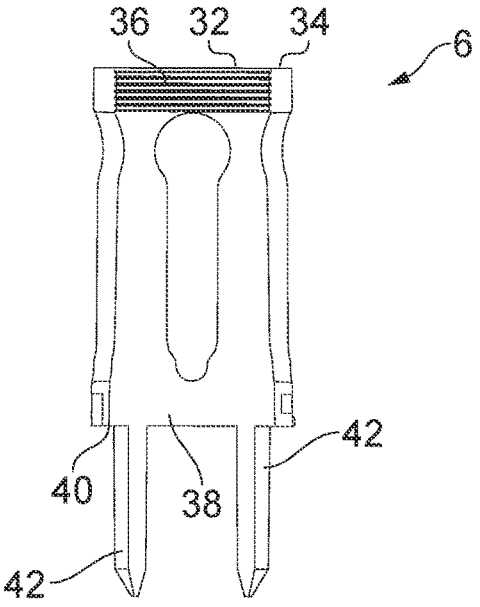
Figure 4D:
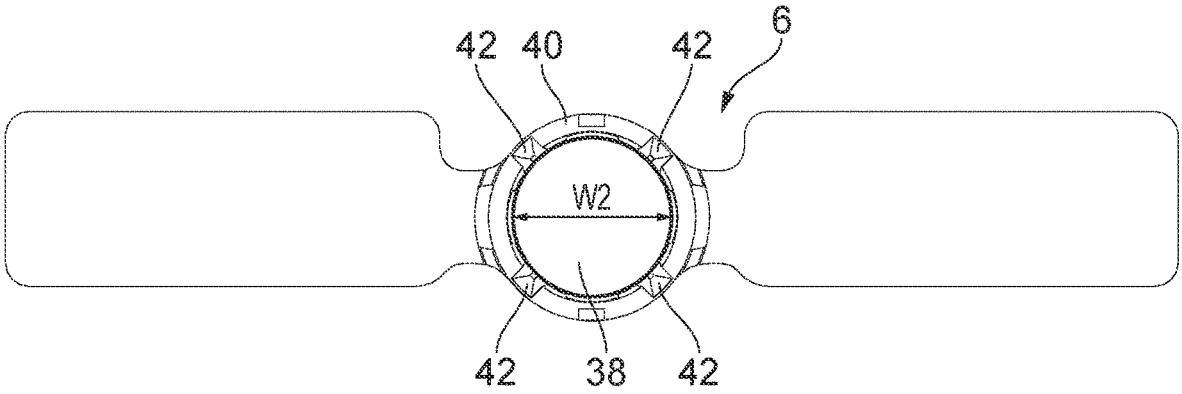
Figure 4E:
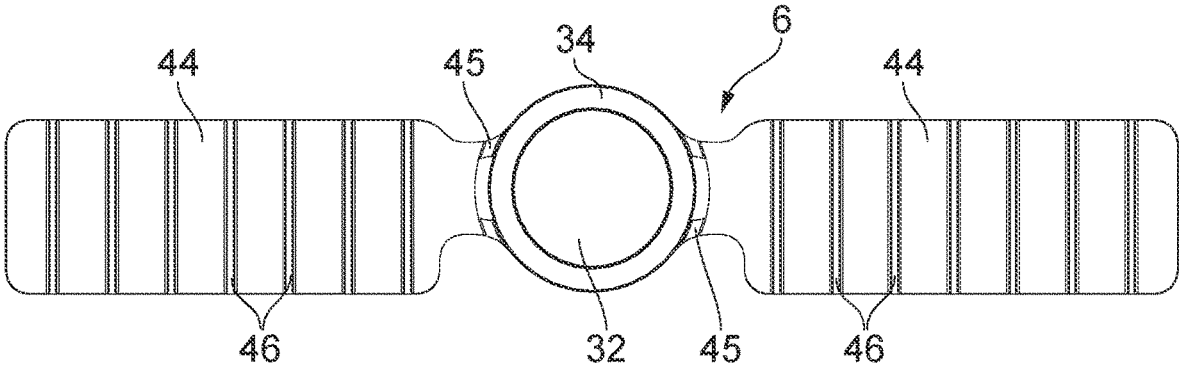

The first part is a hollow element, for example a tube or tubular structure, which may be circular in cross-section (taken perpendicular the longitudinal axis LA) and therefore be cylindrical in shape. It is to be appreciated that other cross-sectional shapes are feasible though. The first part comprises a detonator holder configured to hold a detonator. Although the detonator may be configured to hold one particular type of common detonator, in other examples such as those illustrated, the detonator holder is configured so as to be able to hold different types of detonator, for example those with different widths. As shown in FIGS. 3*a* to 3*e*, the detonator holder comprises a plurality of elements 8 for engagement with an outer surface of a detonator. There may be two or more such elements. In examples shown, there are two pairs of such elements; a first pair 8*a* substantially (within acceptable manufacturing tolerances) opposed to each other and a second pair 8*b* substantially (within acceptable manufacturing tolerances) opposed to each other. Each such element may be a moulding of the first part, such as an arm or a tab, which extends inwards into a hollow or cavity within the first part. Each element may be inwardly biased so that, when engaged with an outer surface of a detonator, they apply an inwards force against the detonator to grip and therefore hold the detonator in place. Two or more such elements would be sufficient to hold a detonator. With the first and second pairs 8*a*, 8*b*, the detonator holder is configured to hold detonators of a greater range of widths. For example, without the detonator present, the first pair of inwardly biased elements are separated from each other by a first minimum separation 10, and the second pair of inwardly biased elements are separated from each other by a second minimum separation 12, taken in the same plane as the first minimum separation 10 and smaller than the first minimum separation. Hence, the first pair of elements can accommodate wider detonators and the second pair of elements can accommodate narrower detonators. FIG. 3*c* shows an example detonator 14, shown with a dashed line, inserted through an aperture 16 at one end 18 of the first part, and held by the detonator holder within the hollow of the first part. An extent of insertion of the detonation wavefront controller may be determined by a user; in some examples an end of the detonator lies in the same plane as, so as to be flush with, the aperture 22, whereas in other examples the end of the detonator may be inserted to a lesser extent, to allow for a space (between the aperture 22 and the end of the detonator) filled with explosive material (such as a pellet as described below). If the detonator is inserted to a lesser extent, an inner surface of the first part may be configured, for example positioned, shaped and/or dimensioned, to at least partly shape a detonation wavefront output by the detonator and as it propagates through the rest of the first part.

At a second end 20 of the first part, there is an aperture 22 (elsewhere referred to herein as the first aperture) which is an opening for outputting a detonation wavefront emitted from a detonator. A width W1 (elsewhere referred to herein as the first width) of the first aperture is determined for example by a thickness T of at least part of a wall 24 of the first part which surrounds the hollow of the first part. In examples shown, a portion 26 of the wall 24 has a constant thickness, within acceptable manufacturing tolerances, between the second end 20 and the detonator holder. In other examples, the thickness of the portion 26 of the wall may change along the length (corresponding to a longitudinal axis LA) of the DWC. The first aperture is for example circular, with the width W1 a first diameter. Hence, a shape of an inner surface of the portion 26 of the wall 24 may be cylindrical in some examples, but in other examples may be differently shaped, for example conical or frustoconical (with the cone for example widening towards the first aperture) to help modify a detonation wavefront output by the detonator and before being output through the first aperture 22.

The first part is configured for engagement with the second part such that the first part and the second part may be moved relative to each other to change a configuration of the DWC. An outer surface of the first part may be configured to at least partly engage with, and enable such movement relative to, an inner surface of the second part, and also to provide sufficient friction or other contact or resistive force against the second part to hold the DWC in a particular configuration once the first and second parts have been moved into position for that configuration. For example, an outer surface of the first part comprises one or a plurality of protrusions, for engagement with a corresponding structure such as one or a plurality of recesses of an inner surface of the second part. Such one or a plurality of protrusions may be distributed longitudinally along the first part, in a direction parallel the longitudinal axis LA and may be circumferential ridges 27 which each at least partly surround a perimeter of the first part in a respective plane taken perpendicular to the longitudinal axis LA.

The end 18 of the first part opposite to that the end the first aperture may be configured to assist a user to grip the first part and move it relative to the second part. For example, a portion 28 of the first part may be enlarged, for example wider, for example with a larger diameter, compared with a different portion narrower than the wider portion. The wider portion may be gripped by a user to push or pull the first part into or out of the second part, with the different, narrower portion, sized to be received within a hollow of the second part. An outer surface of the wider portion 28 may be contoured or otherwise configured to enhance grip for a user, for example with circumferential grooves or recesses.

Where the first part widens between the narrower different portion and the wider portion 28, there may be a surface joining the outer surface of the two portions. This surface is for example referred to herein as a second part contact surface 30, and is for example an annular surface, which is located to stop movement of the second part, relative to the first part, beyond the second part contact surface. In this way, the position of the first part relative to the second part for the first configuration is determined by the position of the second part contact surface 30, as the second part when in contact with the surface 30 cannot be moved to collapse the DWC further.

The second part will now be described with reference to FIGS. 4*a* to 4*e*.

The second part comprises a hollow element, for example a tube or tubular structure, which may be circular in cross section (taken perpendicular the longitudinal axis LA) and therefore be cylindrical in shape. Other cross-sectional shaped are envisaged though, corresponding to a cross-sectional shape of the first part. The second part is configured to at least partly receive the first part within a hollow or cavity within the second part. Thus, a cross-sectional diameter of an inner surface of the second part is larger than a cross-sectional diameter of an outer surface of the portion of the first part for receipt within second part. Hence, the first part can at least partly be inserted within the second part, until in appropriate examples the second part contacts the second part contact surface 30.

The first part is insertable into the second part through an aperture 32 at one end 34 of the second part. A shape of this aperture corresponds with a cross-sectional shape of an inner surface of the portion of the first part insertable within the second part. Hence, this aperture may be circular. An inner surface of a portion of the second part, for example located at the end 34 with the aperture 32 which receives the first part, may be configured to enable movement relative to the outer surface of the first part received within the second part, and also to provide sufficient friction or other contact or resistive force against the first part to hold the DWC in a particular configuration. For example, the inner surface of this portion of the second part may comprise one or a plurality of recesses for engagement with a corresponding structure such as the one or a plurality of protrusions of the first part described above. Such one or a plurality of recesses may be distributed longitudinally along the portion of the second part in a direction parallel the longitudinal axis LA and may be circumferential recesses 36 which each at least partly correspond with a perimeter of the inner surface of the portion of the second part, taken perpendicular to the longitudinal axis LA.

The second part comprises an aperture 38 (elsewhere referred to herein as a second aperture), for example at an opposite end 40 of the second part from the end 34. A width W2 (elsewhere referred to as a second width) of the second aperture 38 is larger than the first width W1 described above. The second aperture, like the first aperture, may be circular with the second width W2 being a second diameter.

As shown in FIGS. 1 and 2, the DWC may be configured in a first configuration or a second configuration, depending on the position of the first part relative to the second part. Hence, a distance between the first aperture 22 and the second aperture 38 is changeable by collapsing or uncollapsing the DWC. In the first configuration there is a first distance D1 (not illustrated as explained below) taken between the first aperture 22 and the second aperture 38, and in the second configuration there is a second distance D2 taken between the first aperture 22 and the second aperture 38. The first and second distances D1, D2 are each taken in a direction parallel the longitudinal axis LA.

In the second configuration, the second distance D2 is larger than the first distance D1. So, in the first configuration, the first distance D1 is smaller than the second distance D2. In some examples, such as those illustrated, in the first configuration the first part may be positioned such that the first aperture 22 and the second aperture 38 each lie in substantially (for example within +/−1 millimetres) the same plane (taken perpendicular the longitudinal axis LA). In the second configuration, the first aperture 22 is nearer to the second aperture 38 than the detonator holder.

In some examples, the second part is configured for attachment to a linear shaped charge. For example, the second part may comprise one or more prongs 42, which may be considered as spikes, pointed elements or similar, which extend from the second part, away from the second aperture and the first aperture, for insertion into the explosive material of a linear shaped charge. The prongs may for example extend from a wall of the second part and may be circumferentially spaced around the second aperture. With the prongs inserted into an explosive material of the linear shaped charge, the DWC may be held firmly in place for detonation to occur. In other examples, the second part may comprise one or a plurality of tabs 44, which may each be considered a flap or other element extending outwards from the second part. At least one tab may be hingeable 45 relative to the hollow element of the second part. Further, at least one tab may be foldable along one or more creases or thinned parts 46 of the tab. Such hinging and folding capability increases the options for attaching the DWC to a linear shaped charge. For example, the tabs can be hinged upwards or downwards to accommodate the DWC in a narrow space, and folding the tabs can shorten their length or enable them to be attached to surfaces with different orientations. With an adhesive, such as an adhesive tape, the tabs can be attached to the linear shaped charge to hold the DWC in position for detonation. Further, any of the prongs or tabs may be removable, for example by cutting them from the second part by snapping or using an appropriate tool, in case they are not compatible for a given situation of attaching the DWC to a linear shaped charge. For example, when the DWC is used with the third part described later, the prongs may be removed so they do not interfere with the detonation wavefront output from the second aperture.

Figure 5:
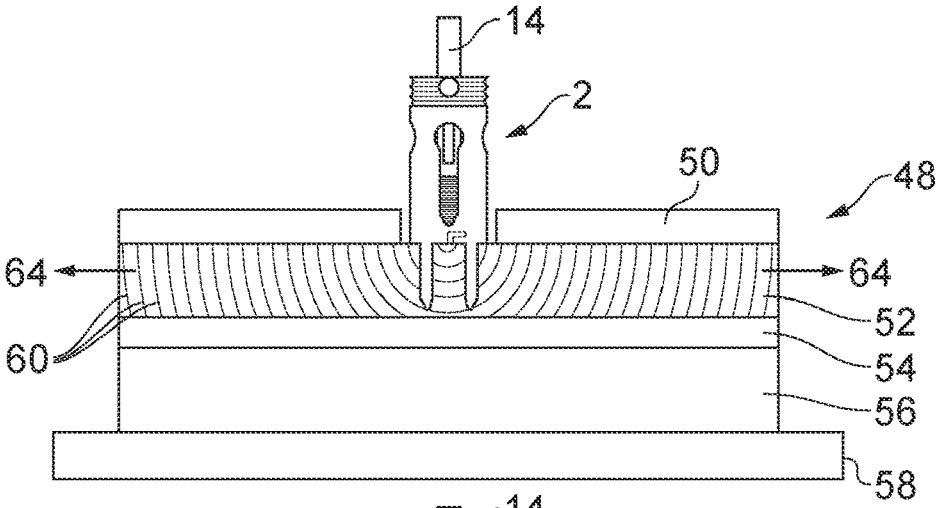
FIGS. 5, 6 and 7 show use of the DWC with a linear shaped charge.
Figure 6:
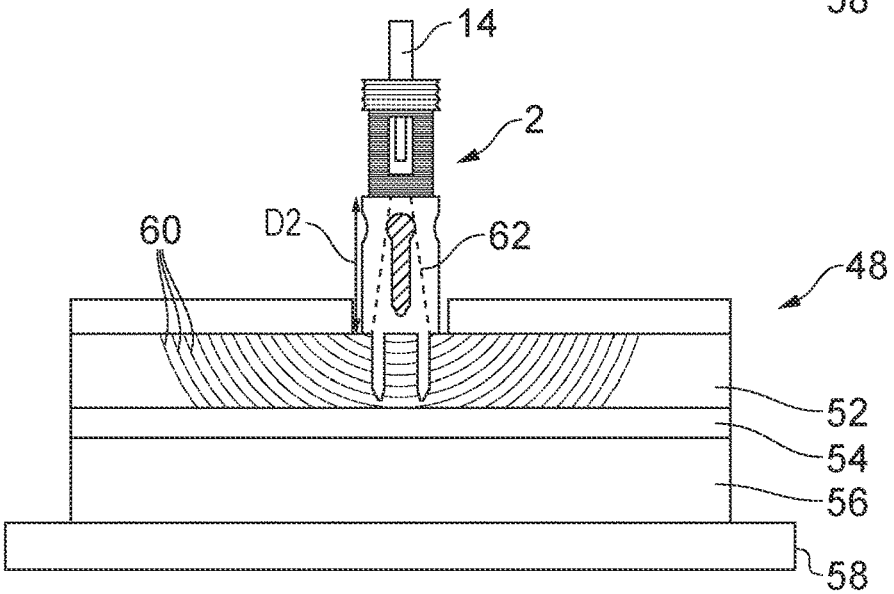
Figure 7:
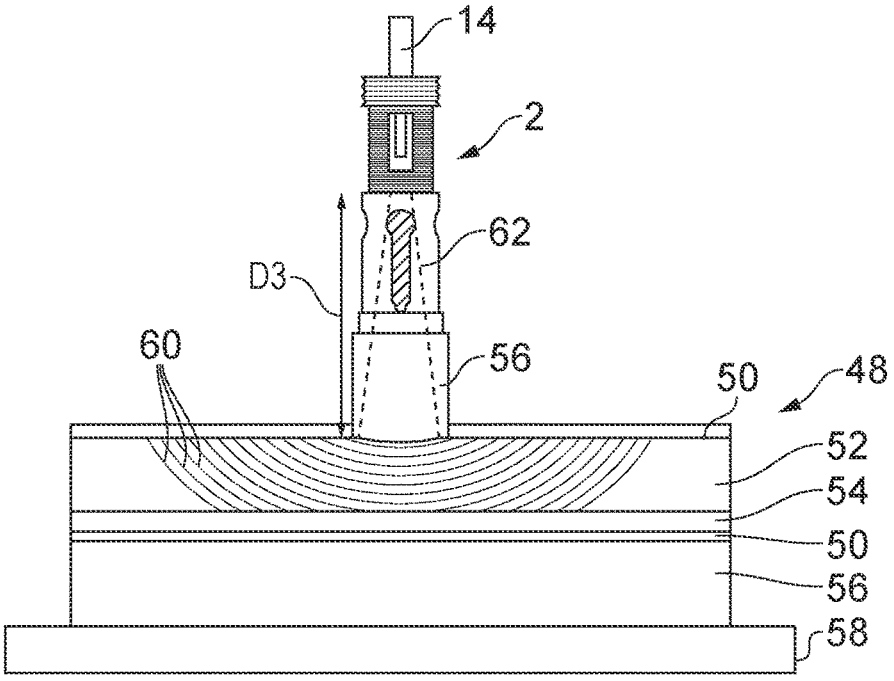

FIGS. 5, 6 and 7 show schematically the DWC 2 in different configurations attached to a linear shaped charge 48. Further details of such a linear shaped charge are explained later, but shown in FIGS. 5, 6 and 7 in cross-section are a casing 50 such as foam in FIGS. 5 and 6 and a plastic housing in FIG. 7, explosive material 52, a liner 54 and a stand-off space 56 which may be at least partly filled with foam, and a target to which the linear shaped charge is attached. In FIGS. 5 and 6, the DWC is attached to the explosive material of the linear shaped charge, through a cutaway in the casing, and so the second aperture is in contact with the explosive material, using the prongs described above inserted in the explosive material 52. In FIG. 7, the second part of the DWC is engaged with a third part 56 which will be described later. In the examples of FIG. 7, the third part is formed as part of the casing 50 of the linear shaped charge, though in other examples the third part may be part of the DWC and attachable to the linear shaped charge for example by tabs or prongs such as those described above.

In FIG. 5, the DWC is in the first configuration described above. In FIG. 6, the DWC is in the second configuration described above. In FIG. 7, the DWC is in a third configuration explained further below. In each of FIGS. 5 to 7 a detonator 14 is inserted in the first part and held by the detonator holder. Upon detonation, the detonator emits a detonation wavefront. In examples, a narrowest part (such as an apex or tip) of a volume (which may be conical or frustoconical) through which the detonation wavefront propagates is located at an end of the detonator inserted in the first part. In the first configuration, with the first aperture for example substantially in the same plane as the second aperture, and therefore in contact with the explosive material of the linear shaped charge, the emitted detonation wavefront is transmitted directly into the explosive material. Hence the first distance D1 may be close to or approximately zero and is not shown in FIG. 5. Propagation of the wavefront is illustrated schematically in FIG. 5 with wavefront lines 60. In the first configuration, with the output of the detonator being closer to the explosive material of the linear shaped charge than in the second configuration, the detonation wavefronts may correspond with those output by the detonator, without modification, and may have a smaller radius than detonation wavefronts input to the explosive material in the second or third configurations.

In contrast, in the second configuration, the second distance D2 shows the separation of the first and second apertures. With the second distance D2 greater than the first distance D1, and the second width of the second aperture, the detonation wavefront output from the detonator may be modified by the second part. An outline of a cross-section of the volume that the detonation wavefront propagates through within the DWC is illustrated with dashed lines 62; the volume is for example conical or frustoconical in shape. At least the second diameter and the second distance determine the dimensions of this conical or frustoconical shape. With this modification of the detonation wavefront by the DWC in the second configuration, the detonation wavefront input to the explosive material of the linear shaped charge has a larger radius than for the first configuration. Hence, as can be seen in FIG. 6, the detonation wavefront interacts with the liner 54 with a less curved, flatter and more planar shape than for the first configuration of the DWC. As a result the quantity of energy received per unit area of the liner, and in turn by the target, from the detonation of the explosive material may be less than in the first configuration.

As a result, in the first configuration, energy from the detonation of the explosive material may be more concentrated in a region directly between the DWC and the target, rather than in regions peripheral to that region. This firing behaviour of the linear shaped charge may be desired in applications where the energy from detonation of the explosive material is required to be transferred at a rapid rate to the liner and in turn to the target, but over a smaller area, for a more sudden cutting action on the target. The form of the wavefront with the smaller radius can lead to part of a wavefront which propagates laterally (perpendicular a longitudinal axis of the linear shaped charge), and thus can be emitted 64 from ends of the explosive material. This effect may be referred to as run-on and can be used to initiate explosive material of a separate charge placed in contact with the initially detonated linear shaped charge, or to cut a portion of the target extending beyond an end of the linear shaped charge.

In contrast, in the second configuration, energy from the detonation of the explosive material is more spread along the liner, and in turn the target, such that the energy from detonation of the explosive material may be transferred at a less rapid rate and over a larger area than for the first configuration. This may be considered a more progressive or continuous delivery of energy to the target than in the first configuration, which may be more suited for certain target materials than others, where a slower rate of energy transfer is required over a longer period of time to the target. This can be contrasted with the higher energy transfer over a shorter time period and a smaller area in the first configuration. With the second configuration, it may be desirable to detonate the linear shaped charge at more than one point along a length of the linear shaped charge, using for example multiple DWCs in the second configuration. This may be referred to as an array set up, and each detonation may be initiated by a separate detonator, or may as explained later be initiated by one detonator linked to other DWCs with detonation cord. A similar approach may be used for the third configuration described below. As noted above, the wavefront lines 60 are illustrated schematically and therefore their curvatures and spacing between wavefront lines should not be taken as limiting. Indeed, it is noted that the specific explosive material used may influence the velocity that the wavefront propagates through the explosive material, and in turn for example the spacing between wavefront lines (for example the wavelength), the curvature of a wavefront in the plane of FIGS. 5 to 7, and/or a rate of change in curvature as the wavefront propagates. Hence, as well as selecting a desired configuration of the DWC for a particular firing behaviour, a particular explosive material may be selected too, to tune the firing behaviour of the linear shaped charge further. The rationale of selecting a specific explosive material applies similarly for any explosive material provided in a space of the DWC; for example the explosive material of one or more pellets (described below) may be selected to assist tuning the wavefront shape and propagation behaviour of the wavefront from the detonator to the linear shaped charge.

First and second configurations have been described which have, designed into the DWC, predetermined first and second distances D1, D2 and first and second widths W1, W2, for controlling the detonation wavefront between two desired forms. In such examples, the second width may be at least three times larger than the first width, and the thickness of the portion of wall of the first part may be set accordingly.

It is to be appreciated that the first and second distances and the first and second widths or diameters may be selected to determine the design of a particular DWC implementation to provide a linear shaped charge with two desired firing behaviours. For example, these configurations may be set for use with the same type of linear shaped charge, or may be set so that the DWC enables a standard type of detonator to be used across a more varied range of linear shape charge types.

Further, the DWC may be set in more than the first and second configurations. For example, by moving the first and second parts to a position relative to each other between the positions for the first and second configurations, at least one intermediate configuration may be obtainable by a user. Thus a so-called dial in functionality may be provided for a user, so they can dial in, or in other words, tune the DWC to output a desired detonation wavefront from a number of options between the first and second configurations.

Figure 8:
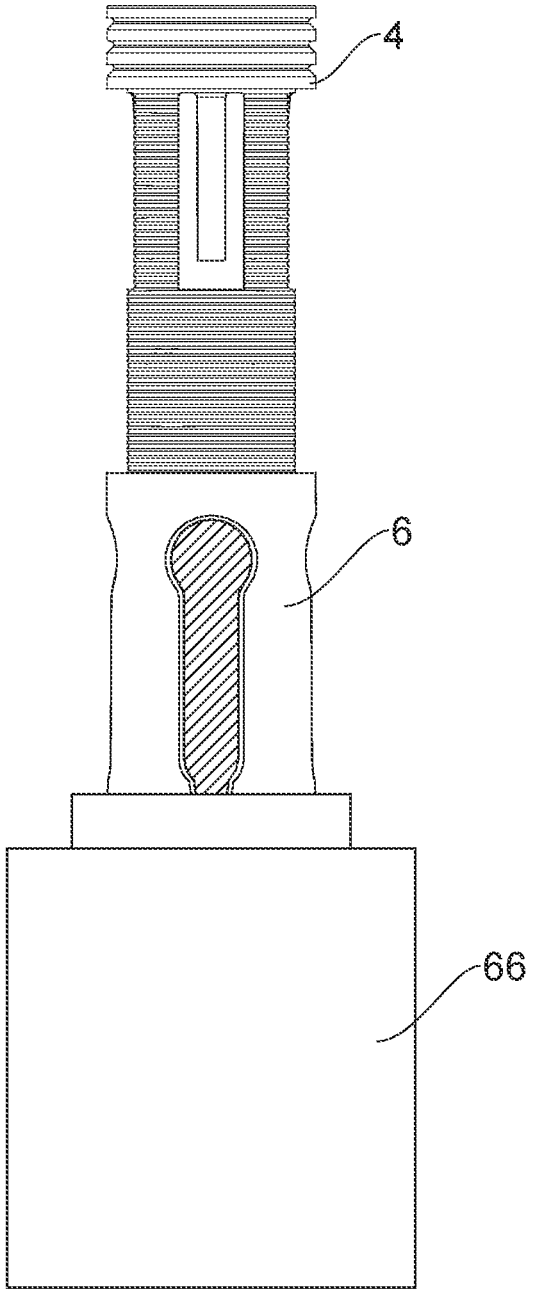
FIG. 8 shows the DWC of FIG. 1 with a third part, according to examples.
Figure 9A:
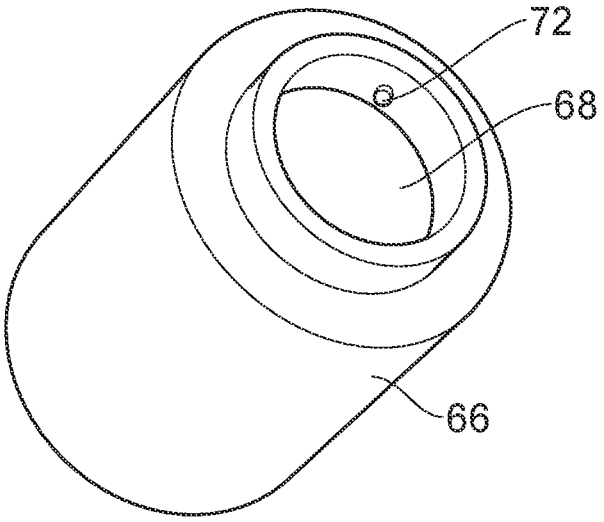
FIGS. 9*a* to 9*d* show various views of such a third part.
Figure 9B:
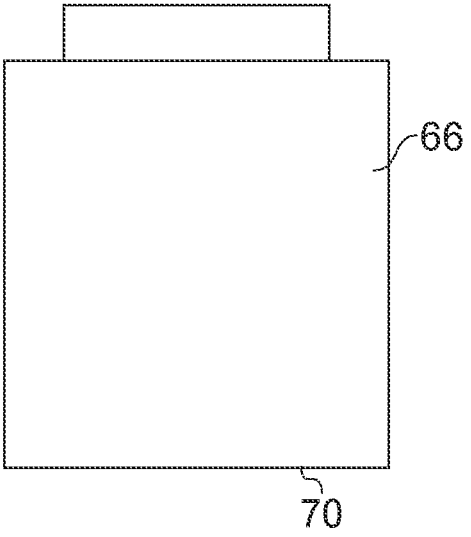
Figure 9C:
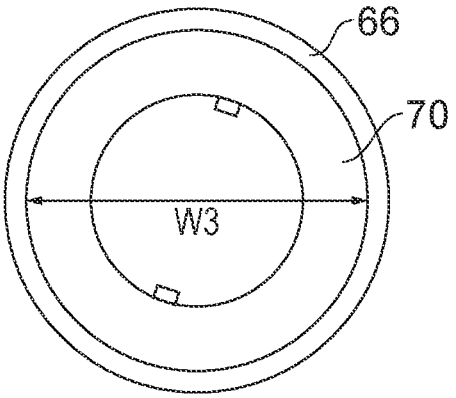
Figure 9D:
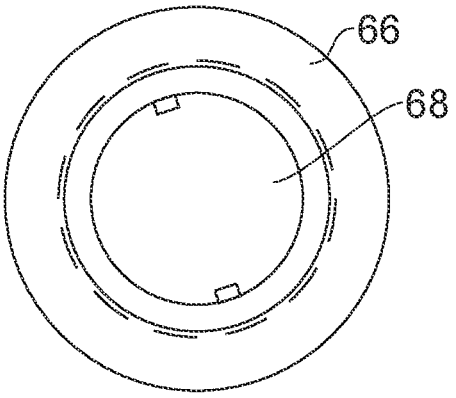

Moreover, in further examples, the DWC may be engaged with, or may comprise, at least one additional part. Such a part may for example be the third part described previously. The third part may be part of the casing of a linear shaped charge, to which the second part is engaged, or in other examples may be a separate part of the DWC which can be engaged when needed, or may instead be a moveable part of the DWC which can be moved relative to the first and second parts, for example with a telescopic action as described above. With the third part engaged with the second part, the DWC is in a third configuration illustrated for example by FIG. 8. FIGS. 9*a* to 9*d* show the third part 66 in, respectively, a perspective view, a side view, a bottom view and a top view.

The third part comprises for example a hollow element for example a tube or tubular structure which may be circular in cross section (taken perpendicular the longitudinal axis LA) and therefore cylindrical in shape. Other cross-sectional shaped are envisaged though, corresponding to a cross-sectional shape of the second part. The third part is configured to at least partly receive the second part within a hollow or cavity within the third part. Thus, a cross-sectional diameter of an inner surface of the third part is larger than a cross-sectional diameter of an outer surface of a portion of the second part for receipt within the third part. Hence, the second part can at least partly be inserted within the third part and engaged at a predetermined position relative to the second part, to locate the third aperture at the third distance from the first aperture.

In examples described, the third part 66 has at one end an aperture 68 or opening shaped and sized to accommodate the second part, and which aperture may be circular. The third part at another end has an aperture (referred to herein as the third aperture 70) through which the detonation wavefront is output. The third aperture has a third width W3, for example a third diameter where the aperture is circular. As shown in FIG. 7, with the third part engaged with the second part, there is a third distance D3 between the first aperture and the third aperture. Moreover, the third width is larger than the first and second widths. For example the third width may be at least five times as large as the first width. As illustrated by the dashed line 62 in FIG. 7, a conical or frustoconical shape of the volume through which the detonation wavefront propagates is determined by the third distance and the combination of first, second and third widths. By appropriate selection in the design of a particular implementation of the DWC of the third distance and the first, second and third widths, a desired detonation wavefront form for the third configuration may be determined, together with desired forms for the first and second configurations. Thus, the first, second and third apertures each correspond with respective and different cross-sectional outlines in different planes (perpendicular the longitudinal axis LA) of a pre-determined cone or frustocone shape.

In the third configuration, a detonation wavefront output by the DWC may have an even larger radius than for the second configuration, which delivers energy over a larger area than in the second configuration, and hence gives a more progressive or continuous energy delivery to the target. than for the second configuration. This can be seen by the wavefronts 60 shown in FIG. 7.

The third part may be engaged with the second part appropriately. For example an outer surface of the second part may have at least one protrusion or recess for engaging with a corresponding recess or protrusion, respectively of an inner surface of the third part. Such protrusions and/or recesses may be located at a predetermined point relative to the longitudinal axis LA to set the third distance when the second and third parts are engaged for the third configuration. FIGS. 9*a* to 9*d* show such protrusions which are in this example pins 72 on an inner surface of the third part and recesses which in this example are slots 74 or grooves in which the pins may be inserted and then slid in a circumferential direction, by twisting one of the second and third parts, to hold the second and third parts against separation. Such a fitting mechanism may be referred to as a bayonet fitting.

It is envisaged that fourth or further parts, which may be similar to the third part, but with larger apertures from which a detonation wavefront is output, may be provided to give a user even more flexibility to select different firing behaviours of the linear shaped charge. Moreover, a size and scale of the first, second, third and/or possibly further parts may be selected on the basis of a size and/or explosive loading of a given or common linear shaped charge, to set the DWC with configurations which give pre-determined firing behaviours for a given linear shaped charge, or give a range of firing behaviours across different types of linear shaped charge.

In examples described above, with the detonator held by the detonator holder, there may be a space between the detonator and the second aperture. This may be the case in the second configuration, and also in the third configuration with a space also between the second and third apertures. Any such space may be filled by a pellet or volume of explosive material, as an intermediate stage for a chain of detonation from the detonator to the explosive material of the linear shaped charge. Such a pellet 70 is shown in various figures with diagonal shading, such as in FIG. 10. Such a pellet may be known to the skilled person as a booster charge. Such a pellet or other explosive material may in some examples be conformable or pliable by a user to fit the space, whereas in other examples such a pellet or other explosive material may be solid, rigid or have a pre-formed shape for insertion into the space.

Figure 10:
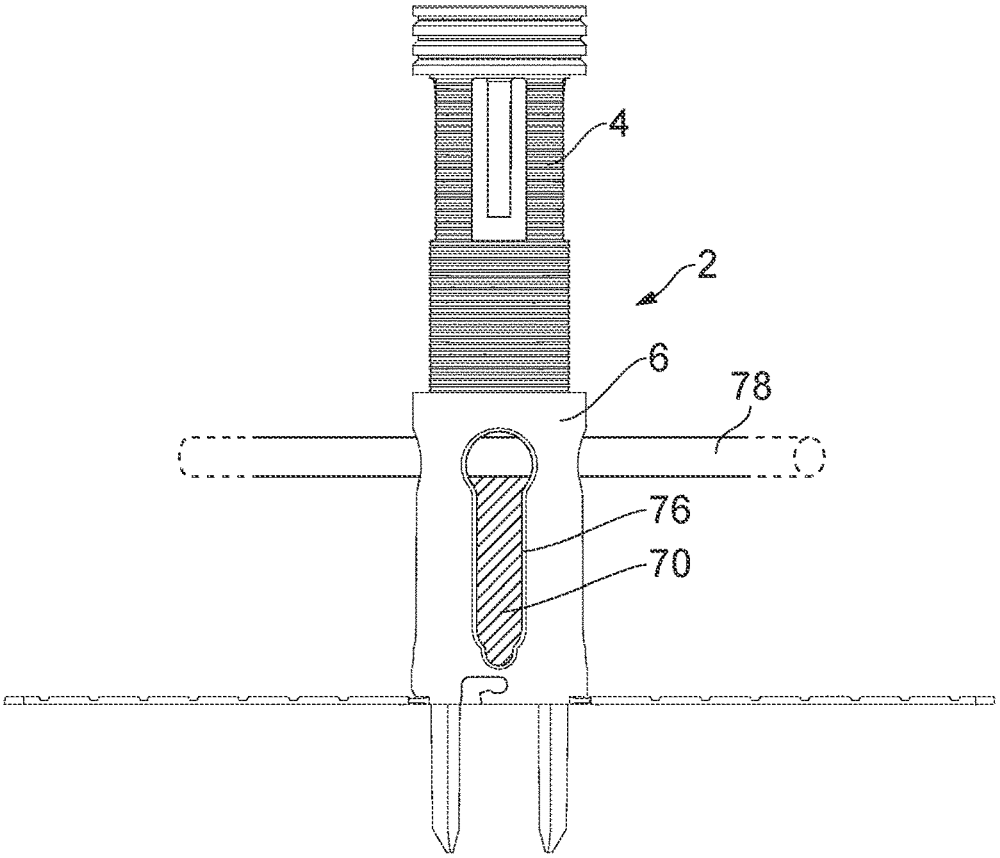
FIGS. 10, 11 and 12 show various uses of the DWC with detonation cord.

FIG. 10 shows how detonation cord or shock tube may be used with the DWC. The DWC of examples gives a user flexibility for detonating one or more linear shaped charge, which may be of different types, with different firing behaviours, and possibly using detonation cord or so-called shock tube to assist firing of one or more linear shaped charges.

Detonation cord is well known to the skilled person and is for example a length of a plastic tube filled with an explosive material. It can be cut to a desired length for use, and when initiated can emit energy radially, in a direction perpendicular a longitudinal axis of the cord. An example of detonation cord is so-called L5A Detonating Cord (available from Chemring Energetics UK) or so-called Primacord® (available from Dyno Nobel Inc., 2795 East Cottonwood, Parkway, Suite 500, Salt Lake City, Utah 84121, U.S.A.).

Shock tube is also well known to the skilled person and is for example a length of a plastic tube with its inner surface coated with an explosive material. In contrast to detonation cord, usually its length cannot be cut as desired, as the effectiveness of the percussive wave transmitted along the tube when initiated would be compromised. Also, shock tube does not emit energy radially as the percussive wave passes along the tube.

In examples, a wall of the second part of the DWC may for example comprise a plurality of wall apertures 76 or openings. Such openings may be shaped and sized to accommodate one cross-section of detonation cord, or more if stacked in a direction parallel the longitudinal axis LA. Hence, each wall aperture may be wider at an end further from the second aperture, for insertion of the detonation cord, then may narrow in a direction towards the second aperture, such that the detonation cord can be slid towards the second aperture and held by the narrower portion of the wall aperture.

FIG. 10 shows a first length of detonation cord 78 passed through a pair of wall apertures which are opposed to each other. The detonation cord is in contact with a pellet 70 of explosive material within the second part, and also may be contacted with a detonator held by the detonator holder of the first part, with the first part moved into the second part sufficiently to press the first aperture against the detonator, and in turn to press the detonation cord against the pellet, and in turn the pellet against the explosive material of the linear shaped charge, for efficient energy transmission to the linear shaped charge. The detonation cord may extend to a second DWC for detonation of the same linear shaped charge at a different location along its length, or a different linear shaped charge as part of an array of linear shaped charges.

Figure 11:
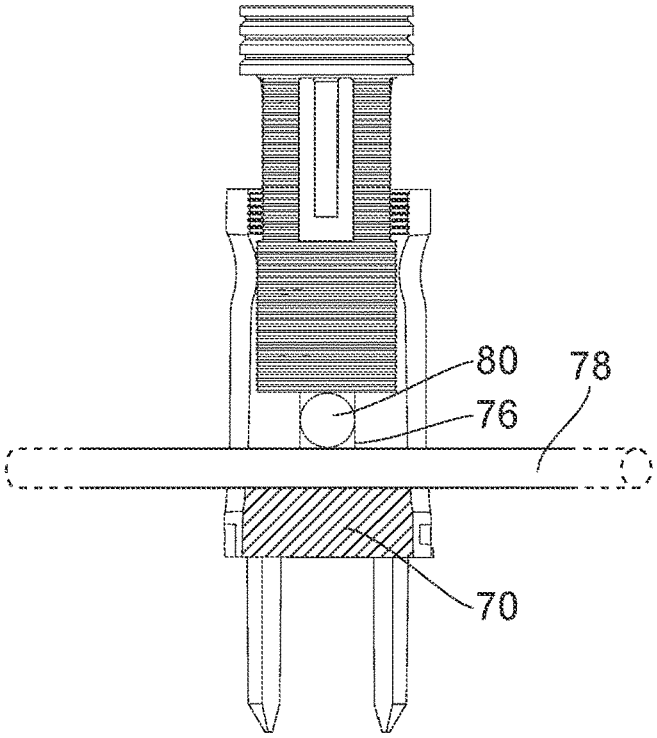
Figure 12:
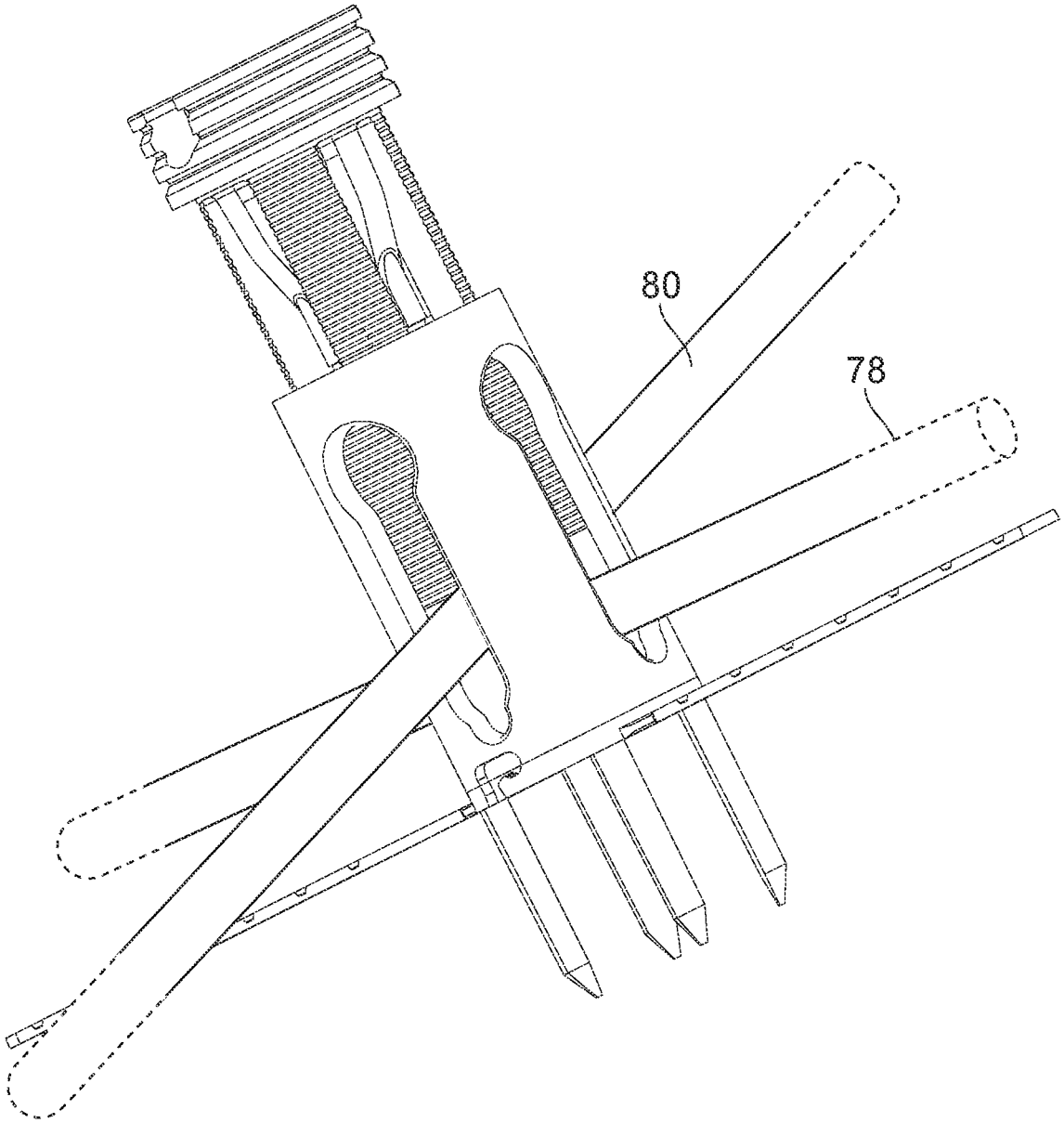

In examples such as those illustrated in FIGS. 11 and 12, the plurality of wall apertures comprises a first pair of wall apertures opposed to each other and a second pair of opposed wall apertures opposed to each other. In this way, a first portion of detonation cord 78 may first be passed through the first pair of wall apertures as described above. A second portion of the same detonation cord, or a different detonation cord, 80, may be passed through the second pair of wall apertures which may be located in a longitudinal plane perpendicular to the first pair of wall apertures. More than two portions or detonation cords may be stacked in this manner and pressed together as described above by moving the first part sufficiently into the second part. This stacking using more than one detonation cord can be used to detonate more than two additional parts of the same linear shaped charge, or two additional linear shaped charges, using one detonator. Alternatively, stacking two portions of the same detonation cord may reduce the chances of a failed detonation, as the detonator can act on two detonation cord portions rather than one. In this way, the DWC can be used as a clip or other fastener for clipping or fastening two portions of the same or different detonation cords together.

Shock tube may be used instead of a detonator, with or without detonation cord inserted through the wall apertures. Hence, the detonator holder may be configured to hold shock tube instead of a detonator, by passing the shock tube through the first part such that its end contacts the detonation cord or a pellet 70. Alternatively, shock tube may be used instead of detonation cord in examples described above. In other examples, a combination of detonation cord and shock tube may be used; for example referring to FIG. 12, feature 78 may be a portion of shock tube and feature 80 may be a portion of detonation cord, such that detonating the detonation cord in turn initiates detonation of the shock tube. Portions of shock tube and detonation cord may be inserted in different opposing pairs of apertures of the detonation wavefront controller, so that the shock tube portion is non-parallel with the detonation cord portion; in other examples to increase a contact area between the shock tube portion and detonation cord portion, these portions may be inserted in the same opposing pair of apertures, so that the detonation cord portion and shock tube portion are parallel or aligned with each other.

Figure 13:
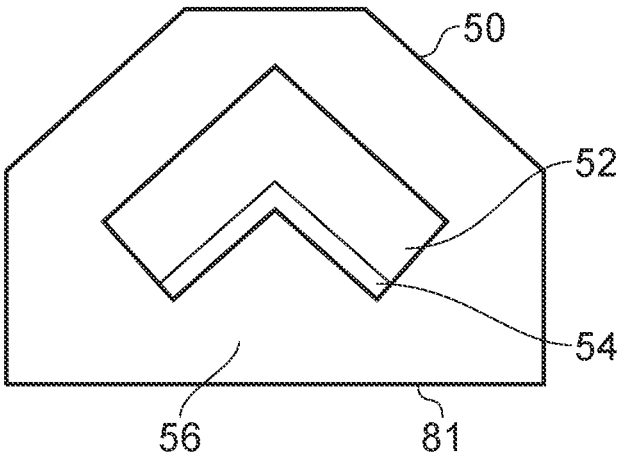
FIGS. 13 and 14 show example linear shaped charges for use with the DWC.
Figure 14:
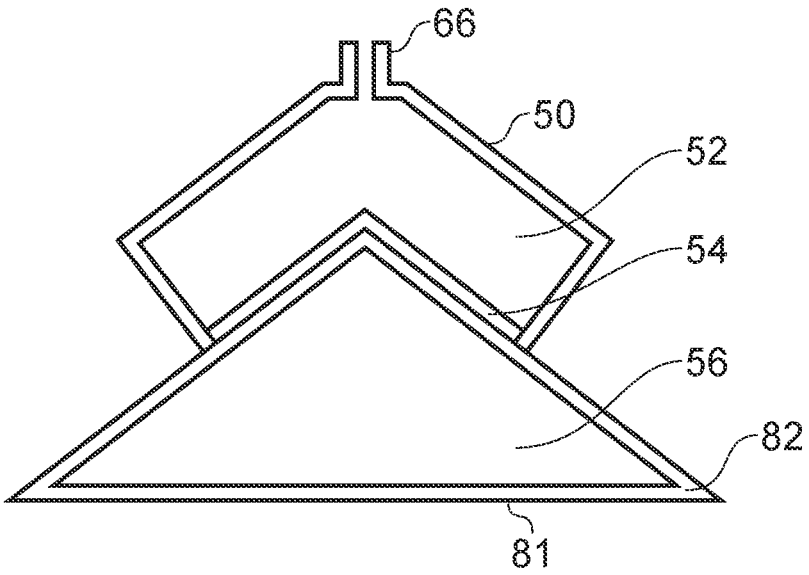

FIGS. 13 and 14 show examples of two different types of linear shaped charge in cross-section, taken perpendicular to a longitudinal axis of the charge. Features described earlier are labelled with the same reference numerals. A linear shaped charge comprises an explosive material 52, a liner 54 and in some examples a surface or face 81 for application to a target, with the liner arranged for projection towards the face when the explosive material is detonated. For example, as will be readily appreciated by the skilled person, a liner may be, before detonation, a longitudinal element having a V-shaped cross section and formed for example of copper or a material comprising copper or another suitable metal. The apex of the V-shape is located further from the target than the two sides of the V-shape. Linear shaped charges may comprise a space 56 between the liner and the face, the liner being arranged for projection through the space after the explosive material (located on a side of the liner furthest from the target) is detonated. At least part of the space may be filled with a filling material and/or surrounded by a casing 82 which may be formed of foam or plastic. Linear shaped charges may also comprise a casing 50 surrounding at least part of the explosive material. The casing and/or filling material may comprise plastic or foam, for example low density polyethylene (LDPE) foam. The casing and the filling material may be integrally formed. A linear shaped charge may be flexible along a longitudinal axis. This allows the target to be cut with a curved shape when the linear shaped charge is detonated. In examples, flexible typically means that the linear shaped charge may be bent, twisted, or otherwise deformed, for example along or relative to a longitudinal axis of the linear shaped charge, for example by a human with their hands without any tools. A linear shaped charge may have elastic properties, so that the linear shaped charge at least partly returns to a pre-deformed configuration. In other examples, the linear shaped charge may have plastic properties, so that for example the linear shaped charge at least partly retains a deformed configuration after being deformed. In some examples, a linear shaped charge may be similar to a linear shaped charge described above, but which is substantially non-flexible, and therefore not for example deformable by a human with their hands without any tools. Such examples may include a linear shaped charge with a rigid copper or other metal liner. In some examples, such as that shown in FIG. 14, the casing 50 is formed to provide the third part 66 described above, for engagement with the second part of the DWC. Thus, the linear shaped charge may be configured to engage with the second part of examples described herein. The linear shaped charge comprises one or more such third part 66 spaced along a longitudinal axis of the linear shaped charge, each third part integrally formed as part of the linear shaped charge, for example in the casing 50. It is envisaged in alternative examples that a linear shaped charge may comprise one or more openings or ports, for example in a casing and appropriately spaced from each other, each for receiving a DWC therein to be inserted into the explosive material as described above.

Examples of the DWC described herein provide a user with various options for controlling and selecting different firing behaviours of a linear shaped charge. This gives the user more options when needing to successfully achieve a given cutting task with a linear shaped charge. The DWC may for example be manufactured of nylon plastic or so-called Grilon® TSS/4 (available from EMS-Chemie AG, Via Innovativa 1, 7013 Domat/Ems, Switzerland).

The above examples are to be understood as illustrative examples. Further examples are envisaged.

In examples above, various apertures are described as being circular, such as the first aperture, the second aperture and the third aperture. The circular shape of any such aperture may be taken in a plane perpendicular the longitudinal axis LA of the DWC and have a centre of the circular shape coincident with the longitudinal axis LA, such that the circular shape is of constant radius about the longitudinal axis LA. In this way, an influence that the shape of any such aperture has on the detonation wavefront may be applied uniformly about the longitudinal axis LA, for example radially uniformly. In further examples, any such aperture may not be perfectly circular, but may be substantially circular, for example circular within acceptable manufacturing tolerances (and thus accounting for any imperfections or minor irregularities in shape due to an imperfect manufacture process). In other examples, the shape of one or more of the first, second or third apertures may for example be a cyclic polygon. A cyclic polygon may be considered a polygon which is cyclic, with all vertices of the polygon lying on a common circle. In other words, a single circle can be drawn on which all vertices of a cyclic polygon are located. Such a single circle may be considered a circumscribed circle. Various shapes of such apertures are envisaged which are each a cyclic polygon, including regular and irregular polygons; specific examples include a triangle, square, hexagon, octagon, decagon, or dodecagon. In alternative examples, any such aperture may be considered an approximation of a circle in shape, for example an ellipse. Such a cyclic polygon may be substantially a cyclic polygon or such an ellipse may be substantially an ellipse, to account for any acceptable manufacturing tolerances.

In examples therefore, an aperture (which may correspond to a respective edge of an inner surface of the wall of the first part, the second part and/or the third part), or an inner surface of the wall of the first, second or third part, may be free from protrusions or other inwardly extending structures which might interfere with the detonation wavefront as it propagates through the DWC, and which might in some examples detract from the generally radially uniform nature of the detonation wavefront.

In examples described above, the DWC is inserted in a longitudinal surface of the explosive material of the linear shaped charge. It is envisaged that in further examples the DWC may instead be inserted in an end of the explosive material of the linear shaped charge. In this way, when detonated, a detonation wavefront may propagate along a length of the linear shaped charge, parallel to a longitudinal axis. Such detonation may maximise a so-called run-on, with the cutting jet extending from the opposite end of the linear shaped charge. This gives the user yet more options for selecting a desired firing behaviour of a linear shaped charge.

In examples described above, any of the first part, the second part, the third part, and possibly further such parts, of the DWC may be provided separately to each other, for example as part of a kit where a user may select appropriate parts to assemble a desired DWC. Alternatively, any of such parts may already be engaged with each other such that the DWC is ready to be set to the desired first, second, third, or possibly intermediate configuration, for use.

It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the accompanying claims.

What is claimed is:

1. A detonation wavefront controller for a linear shaped charge, comprising:

a first part comprising:

a detonator holder, and a first aperture having a first width and a shape which is substantially a cyclic polygon, substantially an ellipse or substantially circular; and a second part comprising:

a second aperture having a second width larger than the first width, wherein, with the first part at least partly received within the second part, the first part is moveable relative to the second part to configure the detonation wavefront controller at least between:

a first configuration with a first distance between the first aperture and the second aperture, and a second configuration with a second distance between the first aperture and the second aperture, the second distance larger than the first distance.

2. The detonation wavefront controller of claim 1, wherein in the first configuration, the first aperture and the second aperture each lie in substantially the same plane.

3. The detonation wavefront controller of claim 1, wherein the first aperture is located at an end of the first part such that, in the second configuration, the first aperture is nearer to the second aperture than the detonator holder.

4. The detonation wavefront controller of claim 1, wherein:

the detonator holder comprises a plurality of elements for engagement with an outer surface of a detonator; or the detonator holder comprises a plurality of elements for engagement with an outer surface of a detonator, the plurality of elements each inwardly biased; or the detonator holder comprises a plurality of elements for engagement with an outer surface of a detonator, the plurality of elements comprising:

a first pair of inwardly biased elements substantially opposed to each other and separated from each other, without the detonator present, by a first minimum separation; and a second pair of inwardly biased elements substantially opposed to each other and separated from each other, without the detonator present, by a second minimum separation smaller than the first minimum separation.

5. The detonation wavefront controller of claim 1, comprising a second part contact surface located to stop movement of the second part, relative to the first part, beyond the second part contact surface, to determine the first configuration of the detonation wavefront controller.

6. The detonation wavefront controller of claim 1, wherein:

an outer surface of the first part is at least partly engaged with an inner surface of the second part; or an outer surface of the first part is at least partly engaged with an inner surface of the second part, the outer surface comprising a plurality of protrusions and the inner surface comprising a plurality of recesses engageable with the plurality of protrusions; or an outer surface of the first part is at least partly engaged with an inner surface of the second part, the outer surface comprising a plurality of protrusions and the inner surface comprising a plurality of recesses engageable with the plurality of protrusions, wherein the plurality of protrusions comprises a plurality of circumferential ridges and the plurality of recesses comprises a plurality of circumferential grooves.

7. The detonation wavefront controller of claim 1, the second part comprising a plurality of prongs extending in a direction away from the first aperture and the second aperture.

8. The detonation wavefront controller of claim 1, wherein at least one of:

the second part comprises a plurality of tabs extending outwards from the second part; or the second part comprises a plurality of tabs extending outwards from the second part wherein at least one of the plurality of tabs is hingeable; or the second part comprises a plurality of tabs extending outwards from the second part, wherein at least one of the plurality of tabs is foldable.

9. The detonation wavefront controller of claim 1, a wall of the second part comprising a plurality of wall apertures.

10. The detonation wavefront controller of claim 9, wherein at least one of:

the plurality of wall apertures comprises a first pair of wall apertures opposed to each other and a second pair of opposed wall apertures opposed to each other; or at least one of the plurality of wall apertures narrows towards the second aperture; or the plurality of wall apertures comprises a first pair of wall apertures opposed to each other and a second pair of opposed wall apertures opposed to each other, wherein at least one of the plurality of wall apertures narrows towards the second aperture.

11. The detonation wavefront controller of claim 1, wherein the second width is at least three times larger than the first width.

12. The detonation wavefront controller of claim 1, wherein the first aperture and the second aperture are each substantially circular, and the first width is a first diameter and the second width is a second diameter.

13. The detonation wavefront controller of claim 1, wherein in a third configuration the detonation wavefront controller comprises a third part comprising:

a third aperture having a third width larger than the second width, and a third distance between the first aperture and the third aperture.

14. The detonation wavefront controller of claim 13, the third part engageable with the second part, so as to at least partly receive the second part, to locate the third aperture at the third distance between the third aperture and the first aperture.

15. The detonation wavefront controller of claim 13, wherein at least one of:

in the third configuration, the first aperture, the second aperture and the third aperture each correspond with respective cross-sectional outlines, taken at different planes, of a predetermined cone or frustocone shape; or the third aperture is substantially circular and the third width is a third diameter.

16. A kit comprising:

a first part comprising:

a detonator holder, and a first aperture having a first width and a shape which is substantially a cyclic polygon, substantially an ellipse or substantially circular; and a second part comprising a second aperture having a second width larger than the first width, the second part separate from the first part and engageable with the first part to at least partly assemble a detonation wavefront controller with the first part at least partly received within the second part, the first part moveable relative to the second part to configure the detonation wavefront controller at least between:

a first configuration with a first distance between the first aperture and the second aperture, and a second configuration with a second distance between the first aperture and the second aperture, the second distance larger than the first distance.

17. The kit of claim 16, comprising a third part separate from the first part and the second part and engageable with the second part to at least partly assemble the detonation wavefront controller with the third part comprising:

a third aperture having a third width larger than the second width, and a third distance between the first aperture and the third aperture.

18. The kit of claim 17, comprising a linear shaped charge comprising a casing comprising the third part.

19. A linear shaped charge comprising a part configured for engagement with a second part, a first part at least partly receivable within the second part, the first part comprising:

a detonator holder, and a first aperture having a first width and a shape which is substantially a cyclic polygon, substantially an ellipse or substantially circular; and the second part comprising:

a second aperture having a second width larger than the first width, wherein, with the first part at least partly received within the second part, the first part is moveable relative to the second part to configure a detonation wavefront controller at least between:

a first configuration with a first distance between the first aperture and the second aperture, and a second configuration with a second distance between the first aperture and the second aperture, the second distance larger than the first distance.

20. The linear shaped charge of claim 19, wherein the part configured for engagement with the second part is a third part comprising:

a third aperture having a third width larger than the second width, and a third distance between the first aperture and the third aperture.

* * * * *